US011187008B2

(12) United States Patent
Kwon

(10) Patent No.: US 11,187,008 B2
(45) Date of Patent: Nov. 30, 2021

(54) CLUTCH ENGAGEMENT ASSEMBLY OF DOOR LOCK AND DRIVING DEVICE THEREOF

(71) Applicant: ASSA ABLOY Korea, Seoul (KR)

(72) Inventor: Tae Hoon Kwon, Bucheon-si (KR)

(73) Assignee: ASSA ABLOY KOREA, Seoul (KR)

( * ) Notice: Subject to any disclaimer, the term of this patent is extended or adjusted under 35 U.S.C. 154(b) by 309 days.

(21) Appl. No.: 16/383,744

(22) Filed: Apr. 15, 2019

(65) Prior Publication Data

US 2019/0323263 A1 Oct. 24, 2019

(30) Foreign Application Priority Data

Apr. 18, 2018 (KR) ..... 10-2018-0044801
Apr. 18, 2018 (KR) ..... 10-2018-0044834

(51) Int. Cl.
*E05B 13/00* (2006.01)
*E05B 17/00* (2006.01)
(Continued)

(52) U.S. Cl.
CPC ..... *E05B 13/005* (2013.01); *E05B 1/003* (2013.01); *E05B 9/04* (2013.01); *E05B 13/101* (2013.01);
(Continued)

(58) Field of Classification Search
CPC ..... E05B 1/003; E05B 9/04; E05B 13/005; E05B 13/10; E05B 13/101; E05B 15/00;
(Continued)

(56) References Cited

U.S. PATENT DOCUMENTS 4,429,556 A * 2/1984 Kambic ..... E05B 47/0692 70/149
4,995,248 A * 2/1991 Liu ..... E05B 47/0692 70/107
(Continued)

FOREIGN PATENT DOCUMENTS

EP 0 709 535 A2 5/1996
EP 3 269 904 A1 1/2018
(Continued)

OTHER PUBLICATIONS

Extended European Search Report dated Sep. 19, 2018 issued in European Application No. 19169811.7 (8 pages).
(Continued)

*Primary Examiner* — Christopher J Boswell
(74) *Attorney, Agent, or Firm* — Nixon & Vanderhye P.C.

(57) ABSTRACT

A clutch engagement assembly for a door lock device includes a first shaft having at an end thereof an insertion end portion in which a channel is formed; a second drive shaft having a hollow engagement end portion into which the insertion end portion of the first shaft is inserted; a driving member which provides a driving force; and a pin member that is installed in a state of being elastically supported in the engagement end portion of the second shaft and is movable by the driving member so as to extending through (be inserted in) at least a part of the first shaft and at least a part of the second shaft, thereby causing a clutch engagement or a disengagement between a first shaft and a second shaft. The clutch engagement assembly may provide a relatively small size structure of the door lock device and a firm engagement force.

10 Claims, 19 Drawing Sheets

(51) Int. Cl.

| | |
|---|---|
| ***E05B 47/00*** | (2006.01) |
| ***E05B 1/00*** | (2006.01) |
| ***E05B 9/04*** | (2006.01) |
| ***E05B 15/00*** | (2006.01) |
| ***E05B 15/10*** | (2006.01) |
| ***E05B 27/00*** | (2006.01) |
| ***E05B 65/08*** | (2006.01) |
| ***E05B 81/46*** | (2014.01) |
| ***E05B 17/04*** | (2006.01) |
| ***E05B 13/10*** | (2006.01) |

(52) U.S. Cl.
CPC ..... *E05B 15/00* (2013.01); *E05B 15/101* (2013.01); *E05B 17/0054* (2013.01); *E05B 17/044* (2013.01); *E05B 27/0003* (2013.01); *E05B 65/0811* (2013.01); *E05B 81/46* (2013.01); *E05B 15/0033* (2013.01); *E05B 2047/0026* (2013.01)

(58) Field of Classification Search
CPC ..... E05B 15/0033; E05B 15/101; E05B 27/0003; E05B 17/0054; E05B 17/0058; E05B 17/044; E05B 17/045; E05B 17/046; E05B 47/0676; E05B 47/068; E05B 47/0692; E05B 2047/0026; E05B 2047/0027; E05B 2047/003; E05B 2047/0031; E05B 65/0811; E05B 81/46
See application file for complete search history.

(56) References Cited

U.S. PATENT DOCUMENTS 5,475,996 A * 12/1995 Chen ..... E05B 47/0692 70/218
5,987,945 A * 11/1999 Ruano Aramburu ..... E05B 47/0692 70/107
6,363,762 B1 * 4/2002 Kueng ..... E05B 47/063 70/278.3
6,651,468 B2 * 11/2003 Aramburu ..... E05B 47/0692 70/189
6,837,081 B2 * 1/2005 Ruano Aramburu ..... E05B 47/0692 70/218
7,308,810 B2 * 12/2007 Menta San Miguel ..... E05B 47/0012 70/189
8,001,818 B2 * 8/2011 Imedio Ocana .... E05B 47/0692 70/472
8,561,443 B2 * 10/2013 Sun ..... E05B 47/0692 70/222
9,051,762 B2 * 6/2015 Huang ..... E05B 47/068
10,597,902 B2 * 3/2020 Guo ..... E05B 47/068
10,890,019 B2 * 1/2021 Lien ..... E05B 47/0692

FOREIGN PATENT DOCUMENTS

| | | |
|---|---|---|
| FR | 2 726 312 A1 | 5/1996 |
| FR | 2 928 678 A1 | 9/2009 |
| KR | 10-2016-0016983 | 2/2016 |
| WO | 2013/105697 A1 | 7/2013 |

OTHER PUBLICATIONS

Examination Report No. 1 dated Nov. 18, 2019 issued in Australian Application No. 2019202691 (4 pages).
Examination Report No. 3 dated Nov. 9, 2020 issued in Australian Application No. 2019202691 (5 pages).

* cited by examiner

【Fig 1A】
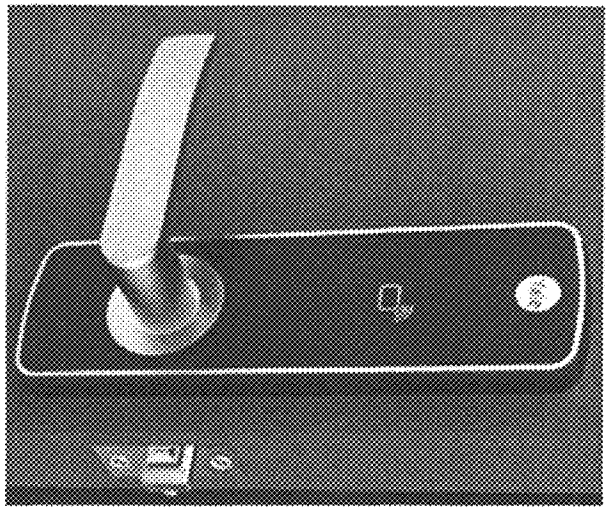
【Fig 1B】
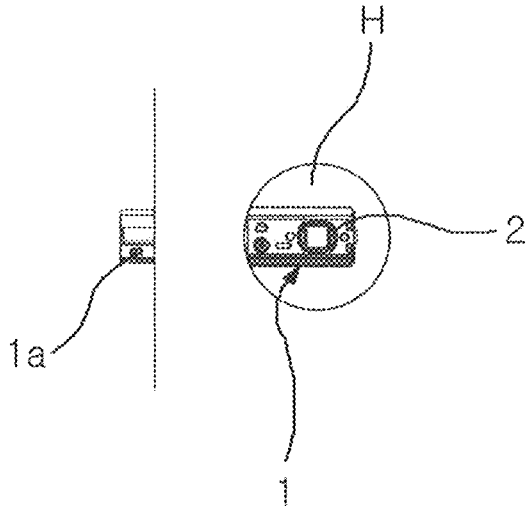

【Fig 2A】
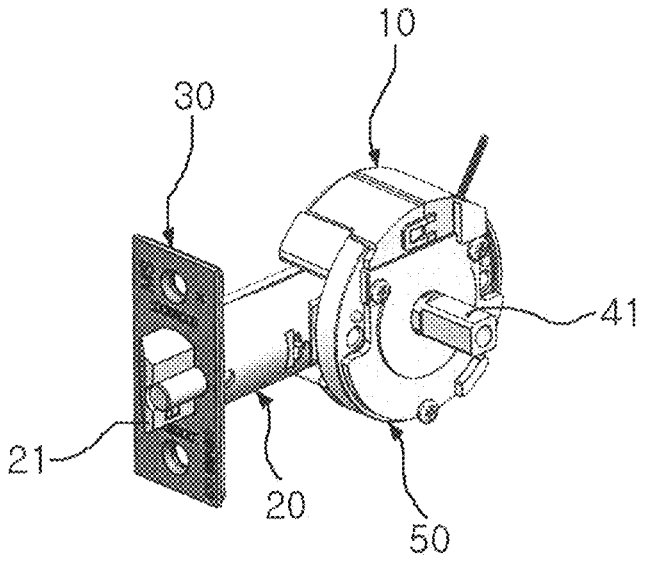
【Fig 2B】
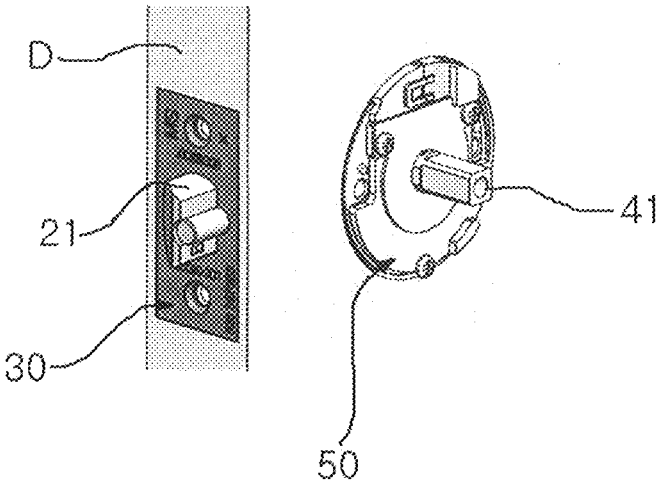

【Fig 3A】
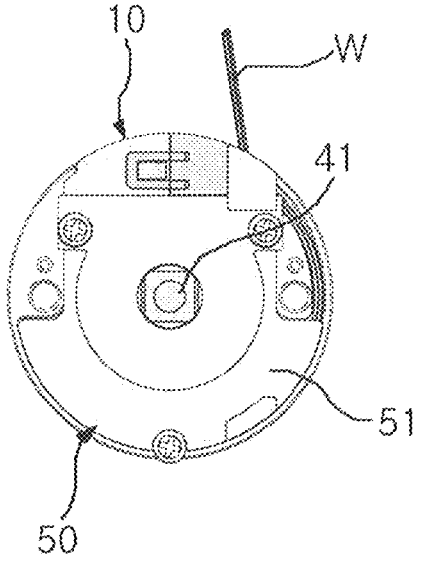
【Fig 3B】
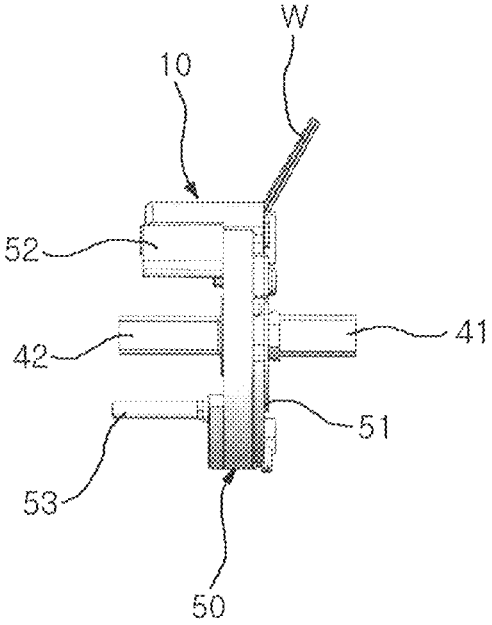

【Fig 3C】
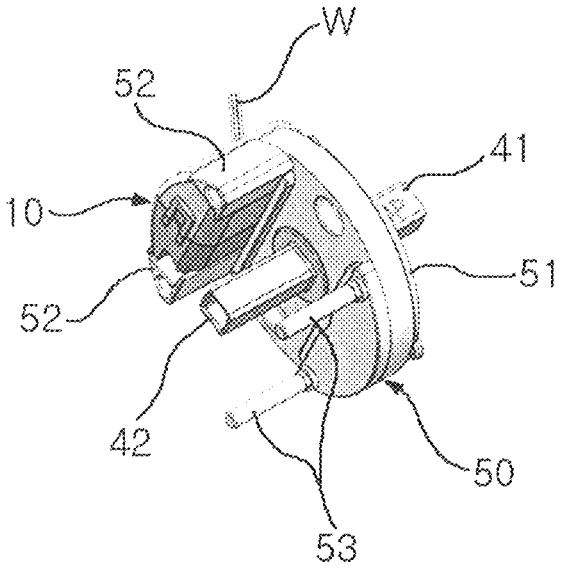
【Fig 4】
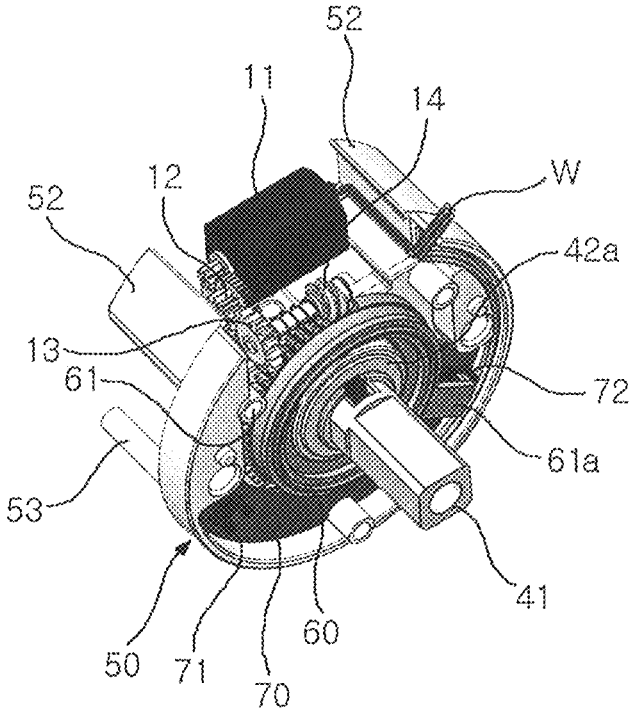

【Fig 5A】
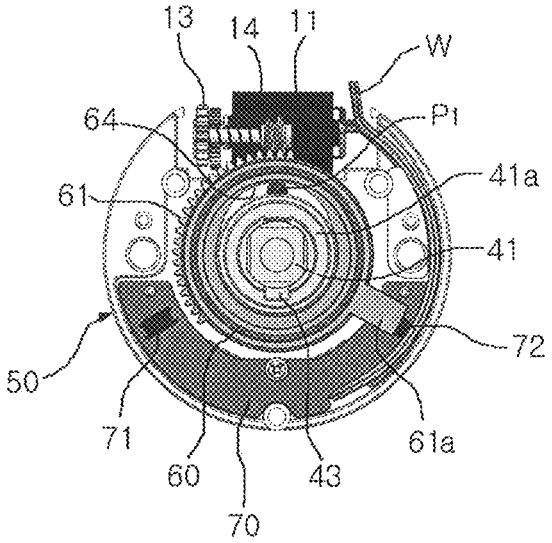
【Fig 5B】
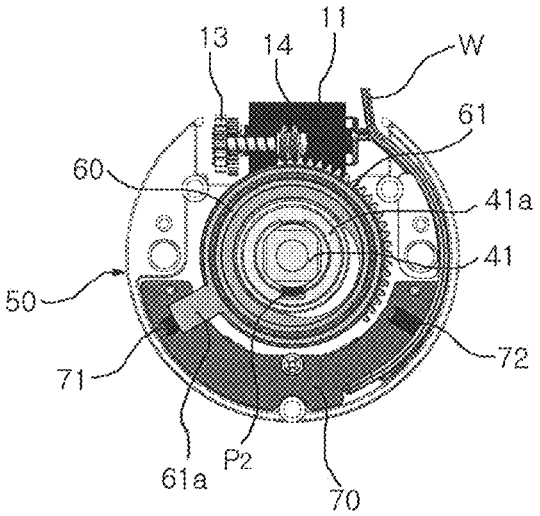

【Fig 6A】
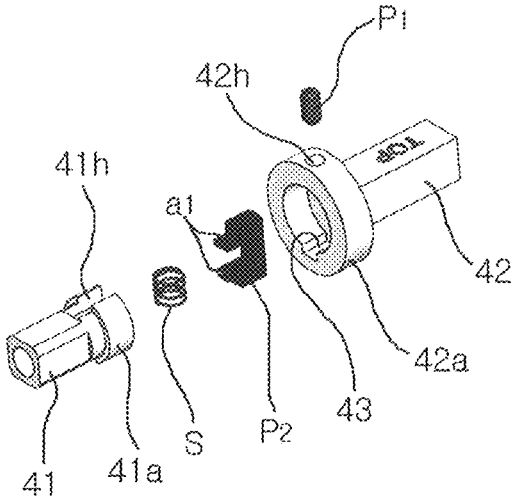
【Fig 6B】
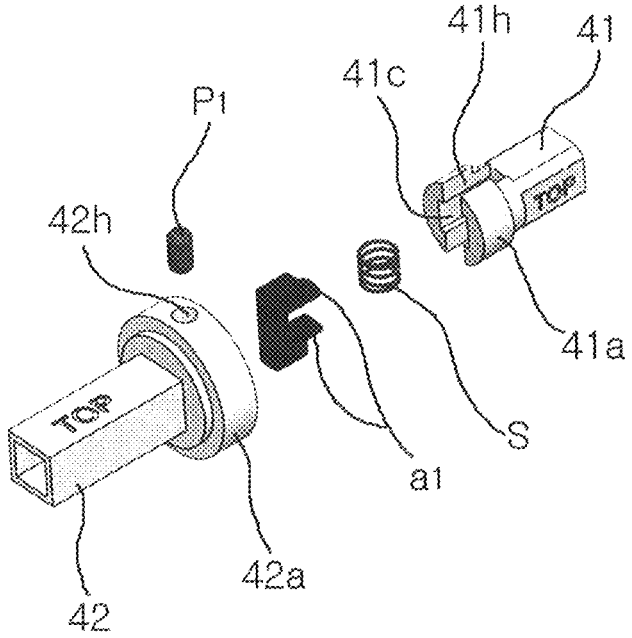

【Fig 7A】
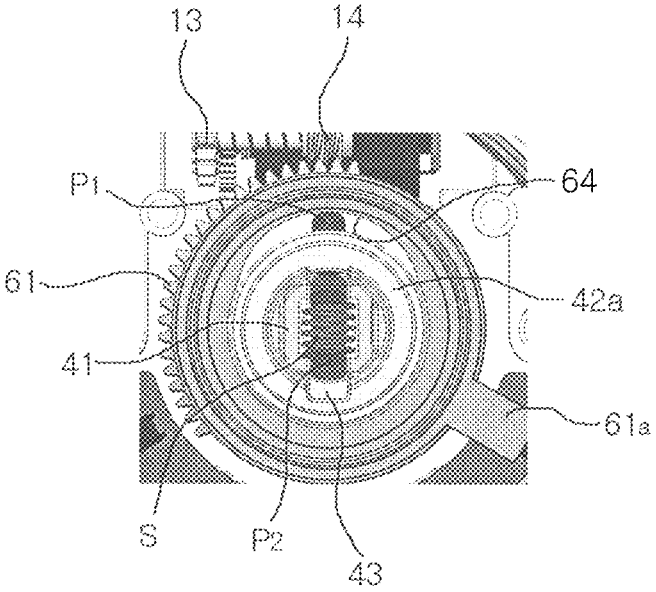
【Fig 7B】
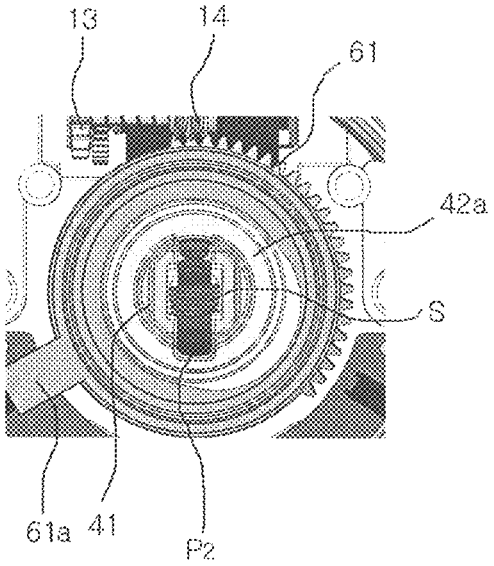

【Fig 7C】
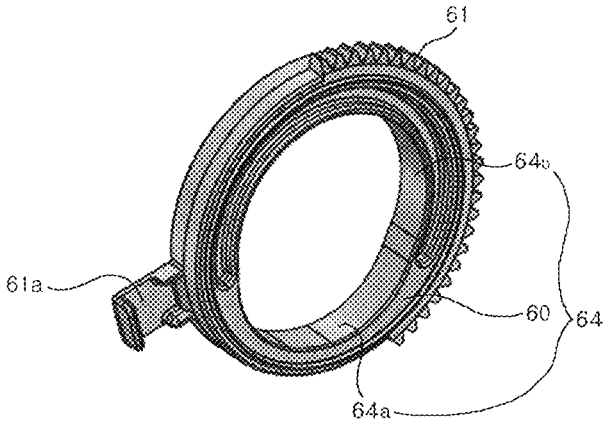
【Fig 8A】
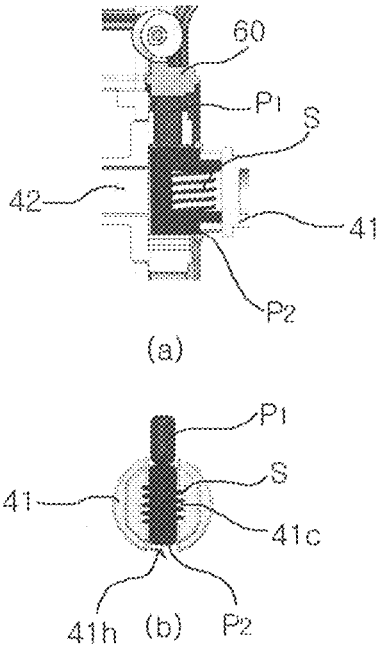

【Fig 8B】
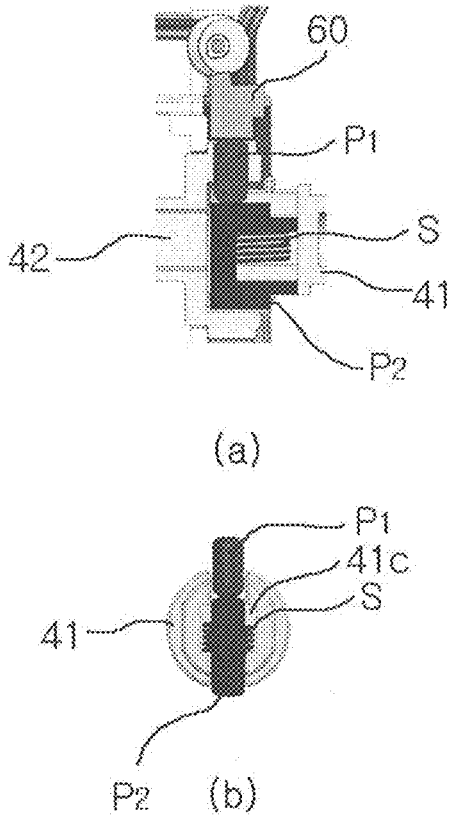
【Fig 9A】
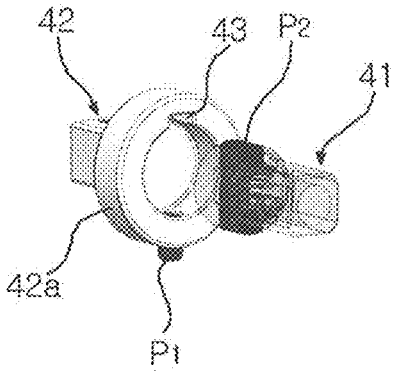

【Fig 9B】
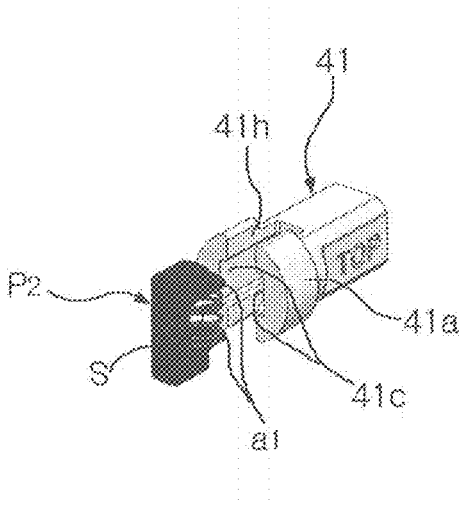
【Fig 10A】
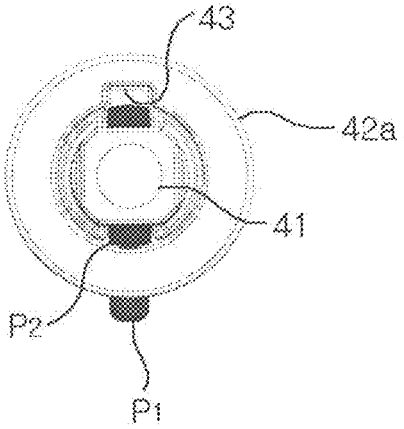

【Fig 10B】
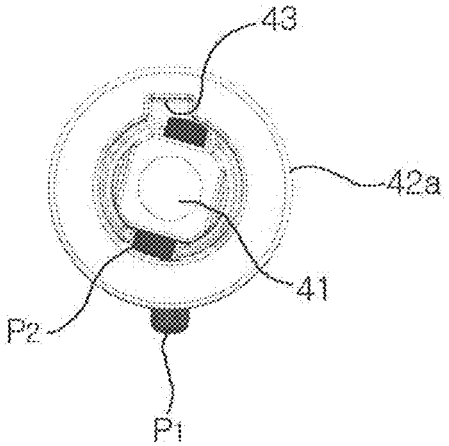
【Fig 10C】
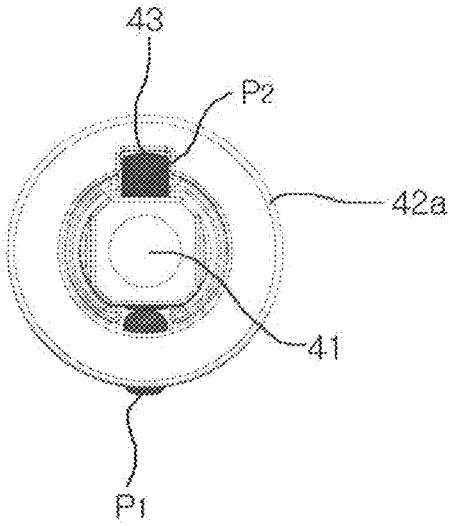

【Fig 11A】
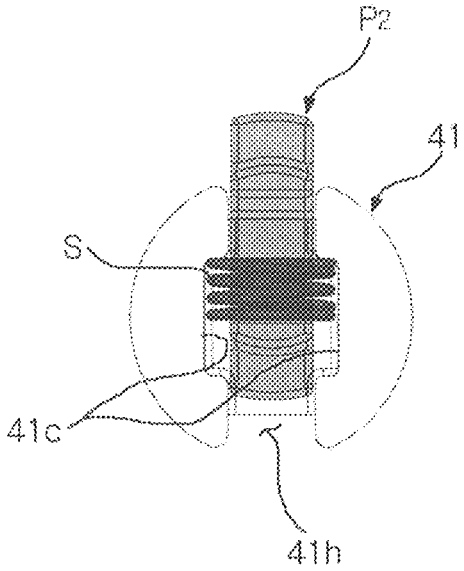
【Fig 11B】
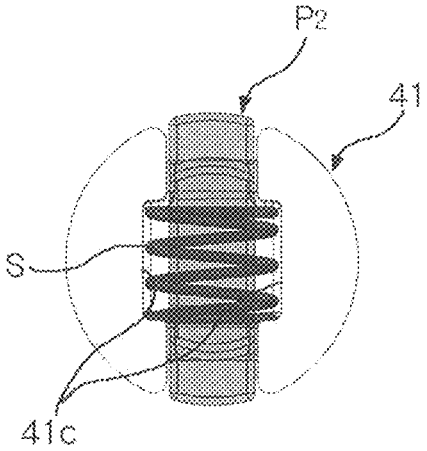

【Fig 11C】
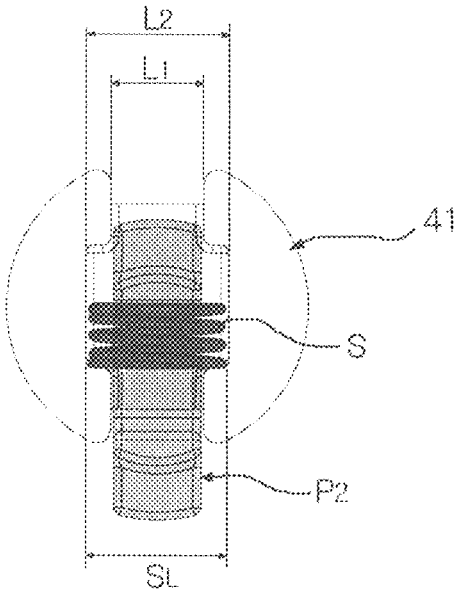
【Fig 12】
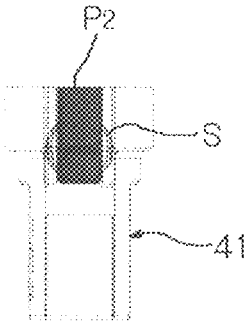

【Fig 13】
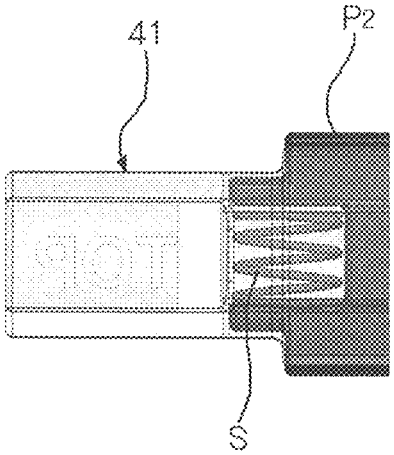
【Fig 14】
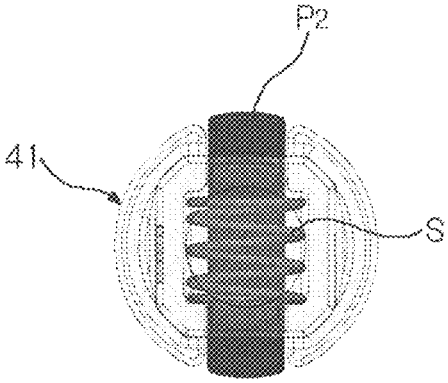

【Fig 15】
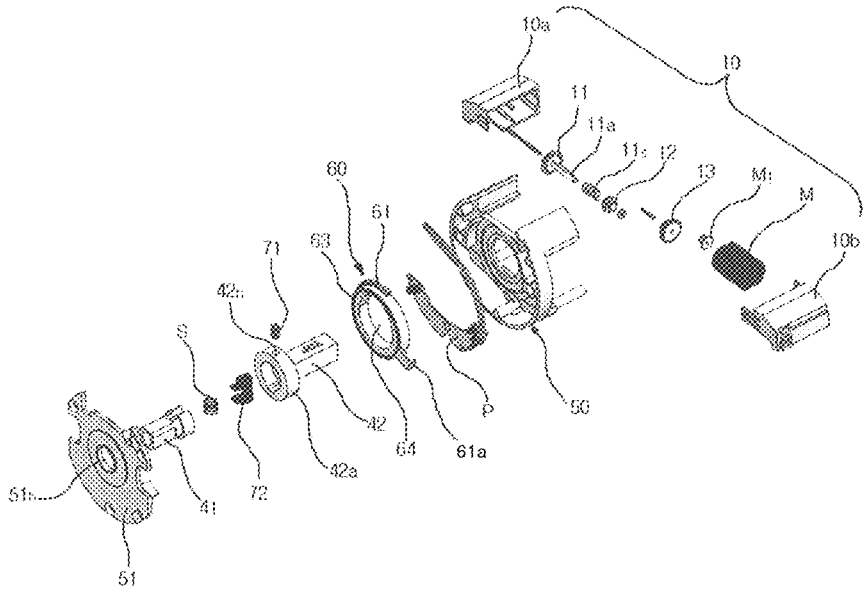
【Fig 16】
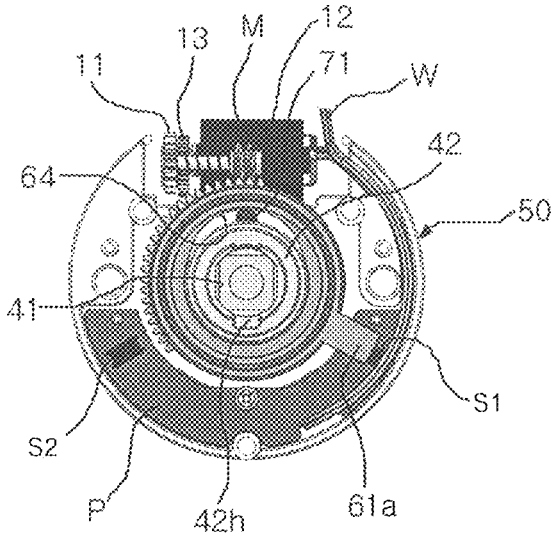

【Fig 17】
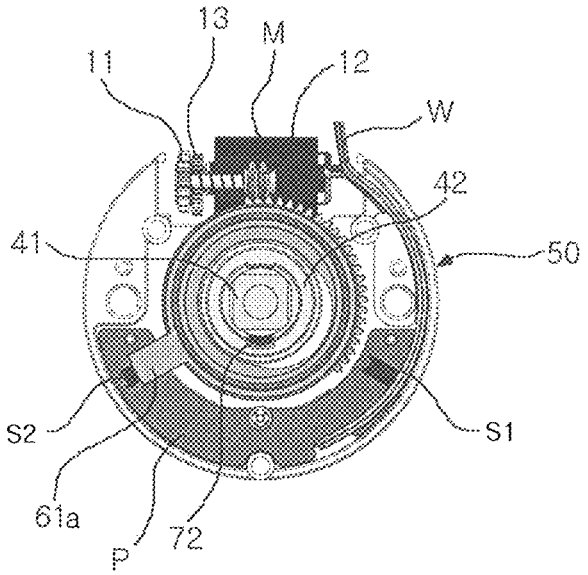
【Fig 18】
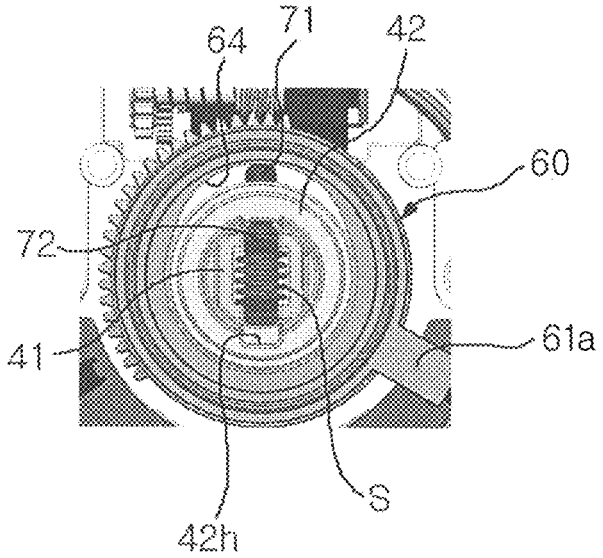

【Fig 19】
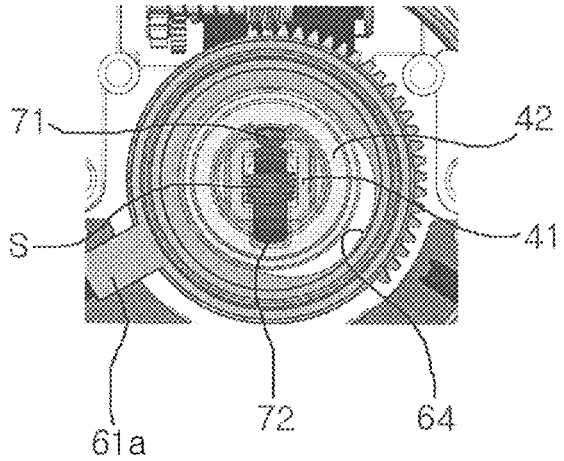
【Fig 20】
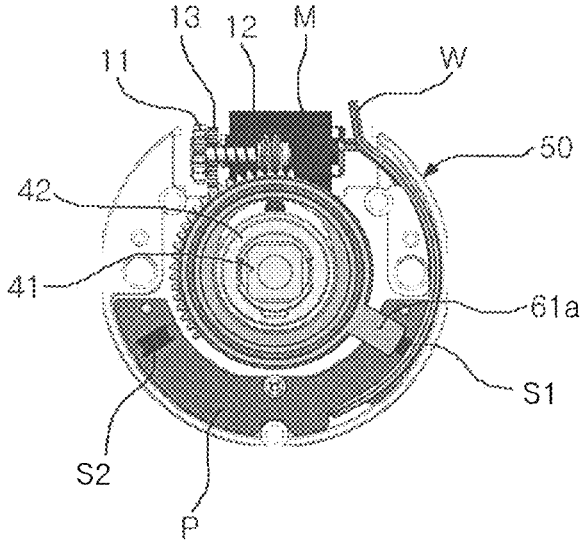

【Fig 21】
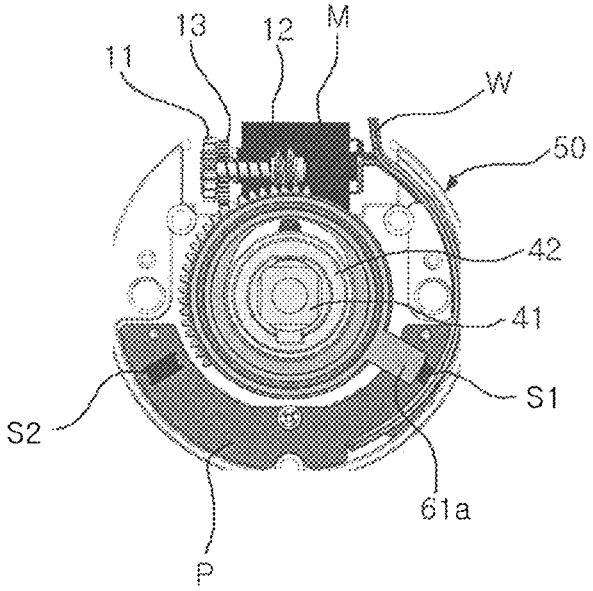
【Fig 22】
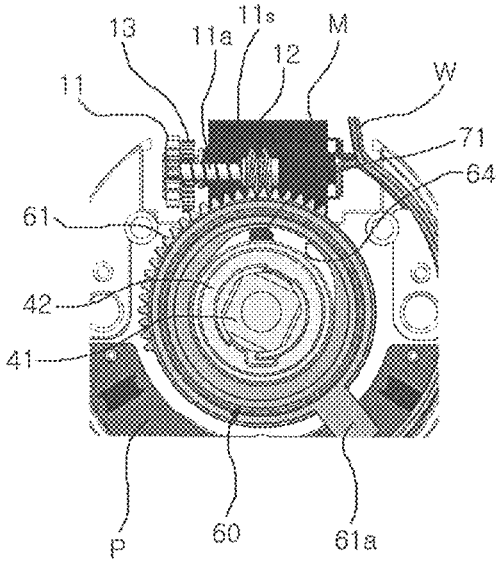

【Fig 23】
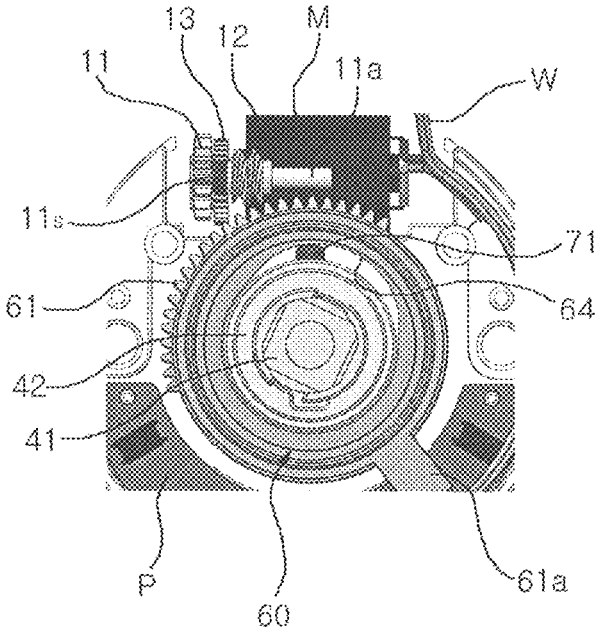

CLUTCH ENGAGEMENT ASSEMBLY OF DOOR LOCK AND DRIVING DEVICE THEREOF

This application claims priority to KR Patent Application No. 10-2018-0044801 filed 18 Apr. 2018, and KR Patent Application No. 10-2018-0044834 filed 18 Apr. 2018, the entire contents of each of which are hereby incorporated by reference.

BACKGROUND OF THE INVENTION

Field of the Invention

The present invention relates to a clutch engagement assembly of a door lock device and a driving device for the clutch engagement assembly thereof, more particularly, to a clutch engagement assembly of a door lock device and a drive device of the clutch engagement assembly to be installed to a lever-type door lock device.

Description of the Prior Art

Generally, lever-type door lock devices are devices in which dead bolts or latch bolts are driven by pivotally rotating either a lever on the indoor side on a lever on the outdoor side to lock and unlock a door.

Such lever type door lock devices include door locks capable of locking and unlocking the door only on the indoor side or door locks capable of locking and unlocking the door on both sides of the door.

FIGS. 1A and 1B are drawings showing a state of the installment of a conventional lever-type door lock device.

Referring to FIGS. 1A and 1B, in the conventional lever type door lock device, an installation hole H of approximately 54 mm in diameter is made by drilling a door D, and a latch operating body 1 is mounted in the installation hole H. Here at one end side of the latch operating body 1, a latch bolt 1*a* is pulled out from the door D, so that a lock state of the door D is established. Further, at the other end side of the latch operating body 1, there is provided an operating body 2 for driving the latch bolt 1*a*.

In such a conventional lever-type door lock device, once there is an authentication from authentication means of the door lock device, the clutch means is in an engagement state and thus the operating body 2 may be driven. That is, the operating body 2 is connected to a handle shaft via clutch means. When there is an authentication of the door lock device, the clutch means are engaged and then the operating body 2 is driven, causing the latch bolt 1*a* to be moved.

However, the conventional operating body 2 of the lever type door lock device has the disadvantages in that, since the operating body 2 is installed outside the door D or inside a door lock body, the downsizing of the device is difficult and the installation performance thereof is lowered.

Further, since some clutch devices applied to the conventional lever-type door lock devices are manufactured as dedicated thereto, these clutch devices are not compatible with other door lock devices, thereby causing a problem of lowering versatility.

[Prior Art 1] Korean Patent Application Publication No. 2016-0016983 (published on: Feb. 15, 2016)

SUMMARY OF THE INVENTION

Accordingly, the present invention is contemplated to solve the above problems. It is an object of the present invention to provide a clutch engagement assembly for a door lock device which may be miniaturized enough to be installed with an installation hole at the door and provide a high versatility; and is configured to be capable of causing a handle shaft to be in its clutch-engaged or clutch-disengaged position in a simple manner due to the simplified configuration of the clutch engagement assembly.

A clutch engagement assembly for a door lock device according to the invention comprising: a first shaft having at an end thereof an insertion end portion in which a channel is formed; a second shaft having a hollow engagement end portion into which the insertion end portion of the first shaft is inserted; a driving member which provides a driving force; and a pin member that is installed in a state of being elastically supported in the hollow engagement end portion of the second shaft and is movable by the driving member so as to be inserted to extend over at least both of a part of the first shaft and a part of the second shaft, thereby enabling a clutch engagement or disengagement between the first shaft and the second shaft.

The pin member includes a first pin member a part of which is exposed outward from the outer surface of the hollow engagement end portion of the second shaft, and a second pin member which is elastically supported inside the insertion end portion of the first shaft and supports the first pin member at a bottom end thereof.

The engagement end portion of the second shaft includes a hollow inner cylindrical surface extending along a longitudinal axis of the engagement portion; a through hole which extends perpendicularly to a longitudinal axis of the engagement end portion; and a connection groove which is formed at a hollow inner cylindrical surface to be diagonally opposite to the through hole, wherein a first pin member is installed in a state of protruding at a predetermined length from the through hole, a second pin member includes a pair of protruding fixing jaws in upper and lower portions thereof and a coil spring is located between the protruding jaws of the second pin member.

At an inner circumferential surface of the engagement end portion there is formed a connection groove into which one end portion of the second pin member is inserted and the connection groove is placed to be diagonally opposite to the through hole.

A mounting groove is formed in the longitudinal direction of the first shaft in inner surfaces of both sides of the channel of the first shaft; wherein the second pin member is positioned to be moveable upwards and downwards in the channel of the first shaft; and wherein the coil spring is actuated only in the mounting groove of the first shaft while being supported by the protruding jaws of the second pin member.

When the first pin member is lowered by the driving member, the first pin member is positioned to extend through both the through hole of the second shaft and the channel of the first channel; wherein the second pin member is lowered while overcoming an elastic force of a coil spring as the first pin member is lowered, so that the second pin member is placed to extend through the channel of the first shaft and the connection groove of the second shaft; and wherein the coil spring is actuated only within the mounting groove formed in the first shaft.

The driving member is formed in a hollow circular plate having an inner curved surface formed therein; and the inner curved curve includes an inner cam surface and a circular inner circumferential surface, and when the driving member rotates, the inner curved surface causes the first and second pin members to be moved upwardly or downwardly within the channel of the first shaft and the through hole of the second shaft and into the connection groove of the second shaft.

A width of the coil spring is greater than a width of the second pin member and smaller than a distance between the mounting groove of the first shaft.

A door lock device includes the above described the clutch engagement assembly thereof wherein the door lock device includes: a mounting module mounted in a installation hole at a door; and a motor unit coupled to the mounting module to provide a driving force; wherein a rotating member in the clutch engagement assembly is a driving plate which is rotated in the mounting module by the driving force of a motor unit.

An outer toothed gear connected to the motor unit by gear connection is formed at a portion of an outer circumferential surface of the driving plate, and wherein the driving plate has at the inside thereof an inner curved surface including an inner cam surface and a circular inner circumferential surface which causes pin members to be moved upwardly or downwardly.

A door lock device includes the above described clutch engagement assembly thereof; and a motor unit coupled to the clutch engagement assembly to provide a driving force.

According to the invention, since a plurality of pin members are inserted to extend over both of the opposite end portions which the driving shafts face, a firm engagement force may be obtained at the time of the clutch engagement of the driving shafts of the door lock device.

Further, according to the invention, a driving plate having at the inside thereof an inner curved surface including an inner cam surface and a circular inner circumferential surface rotates in a driving module to press pin members in a simple manner so that a clutch engagement between the driving shafts may be established. Accordingly, a drive device for the clutch engagement assembly of a door lock device according to the invention may be miniaturized and demonstrate a smooth operation performance.

In addition, it is possible to provide for a drive device of proper dimensions to be applied to various clutch engagement structures tailored to the recent miniaturization of a door lock device, thereby improving versatility.

BRIEF DESCRIPTION OF THE DRAWINGS

FIG. 1A is an installation photograph of a conventional lever-type door lock device.

FIG. 1B is a state diagram showing the installation state of a conventional lever-type door lock device.

FIG. 2A is a perspective view of a driving module to which a clutch engagement assembly of a door lock device according to a first embodiment of the present invention is applied, FIG. 2B is a view showing an installed state of a diving module in FIG. 2A.

FIG. 3A is a front view of a driving module to which a clutch engagement assembly of a door lock device according to a first embodiment of the present invention is applied;

FIG. 3B is a side view of a driving module to which a clutch engagement assembly of a door lock device according to a first embodiment of the present invention is applied, FIG. 3C is a rear perspective view of a driving module to which a clutch engagement assembly of a door lock device according to a first embodiment of the present invention is applied.

FIG. 4 is a perspective view showing an internal structure of a motor unit in a driving module to which a clutch engagement assembly of a door lock device according to a first embodiment of the present invention is applied.

FIGS. 5A and 5B are operational states showing an operating state of a clutch engagement assembly according to a first embodiment of a door lock device of the present invention.

FIGS. 6A and 6B are exploded perspective views of a clutch engagement assembly of a door lock device according to a first embodiment of the present invention.

FIGS. 7A and 7B are operational states of a clutch engagement assembly of a door lock device according to a first embodiment of the present invention.

FIG. 7C is a perspective view of a driving plate of a clutch engagement assembly of a door lock device according to a first embodiment of the present invention.

FIGS. 8A and 8B are operation states of a clutch engagement assembly of a door lock device according to a first embodiment of the present invention.

FIGS. 9A and 9B are partial exploded perspective views of a clutch engagement assembly of a door lock device according to a first embodiment of the present invention.

FIGS. 10A to 10C are diagrams illustrating a pin operation state of a clutch engagement assembly of a door lock device according to a first embodiment of the present invention, FIGS. 11A to 11C are enlarged views showing an operating state of a second pin member of a clutch engagement assembly of a door lock device according to a first embodiment of the present invention, FIG. 12 to FIG. 14 are diagrams showing a state in which a second pin member and a first shaft of a clutch engagement assembly of a door lock device according to a first embodiment of the present invention are engaged.

FIG. 15 is an exploded perspective view of a clutch engagement assembly of a door lock device including driving members according to a second embodiment of the present invention.

FIGS. 16 and 17 are operational states of a clutch engagement assembly of a door lock device according to a second embodiment of the present invention.

FIGS. 18 and 19 are operation states showing operation states of pin members of a clutch engagement assembly of a door lock device according to an embodiment of the present invention.

FIGS. 20 and 21 are diagrams showing a disengagement state of a clutch engagement assembly according to the left and right handed settings of a handle shaft, respectively.

FIGS. 22 and 23 are operation states of connection release members of a driving device for a clutch engagement assembly of a door lock device according to an embodiment of the present invention.

DETAILED DESCRIPTION OF THE EXEMPLARY EMBODIMENTS

Hereinafter, the present invention will be described in more detail with reference to the accompanying drawings. Terms and words used in the present specification and claims should not be interpreted as limited to ordinary or dictionary terms, but should be interpreted in a meaning understood by a person having ordinary skill in the art to which this invention belongs. In the following description and the accompanying drawings, descriptions of known functions and configurations that may unnecessarily obscure the subject matter of the present invention will be omitted. The accompanying drawings are provided by way of example so that those skilled in the art can fully understand the spirit of the present invention. Therefore, the present invention may be embodied in other forms not limited to the following drawings. In addition, like reference numerals designate like elements throughout the specification.

Embodiment 1

Referring to FIGS. 2A and 2B, a latch operating body 20 is coupled to a driving module 50. In a coupled state, the driving module 50 is formed in a truncated disk-like shape. A motor unit 10 is mounted on the top of the driving module 50 and the driving module 50 is generally formed in a disk shape in a state where the motor unit 10 is mounted on the driving module 50. Further, a mounting plate 30 is mounted at a tip end of the latch operating body 20, and the mounting plate 30 is coupled to and fixed to a side surface of a door D. In addition, the latch operating body 20 includes a latch bolt 21 at a tip end thereof.

The driving module 50 and the motor unit 10 having the above-described structure are installed by being inserted in a state of being coupled to each other into a circular installation hole H (see FIG. 1B) of the door D.

Referring to FIGS. 3A to 3C, a driving module 50 is provided with a pair of supporting portions 52 extending rearward from an upper portion of a rear surface thereof. A motor unit 10 is positioned between the pair of support portions 52. A pair of connection posts 53 is formed to extend rearward from a lower portion of the rear surface of the driving module 50. A second shaft 42 is provided between the support portions 52 and the connection posts 53. The second shaft 42 is connected on the same axis to a first shaft 41. A cover plate 51 is provided to cover components of the driving module 50.

FIG. 4 shows an internal configuration of a driving module 50 in which a cover plate 51 is removed from the driving module 50 and a case is removed from a motor unit 10.

The motor unit 10 is configured by connecting a plurality of reduction gears to a motor body 11. Specifically, the reduction gears include an intermediate gear 12, a dependent gear 13, and a worm gear 14 wherein the worm gear 14 is connected on the same shaft to the dependent gear 13 with a certain distance therebetween and is elastically supported by a coil spring. The dependent gear 13 is rotated together with the worm gear 14. Since the worm gear 14 is connected to mesh with an outer toothed gear 61 of a driving plate 60, the rotation of the worm gear 14 causes a driving plate 60 to be rotated clockwise or counter-clockwise.

A first shaft 41 and a second shaft 42 are connected to each other on the same axis at the center of the driving plate 60. Further, the rotating of the driving plate 60 causes the first shaft 41 and the second shaft 42 to be clutch-engaged, thereby being rotated together or causes the shafts 41 and 42 to be clutch-disengaged, thereby breaking a drive connection therebetween. A PCB 70 is mounted below the driving plate 60 and a first sensor 71 and a second sensor 72 are mounted on the PCB 70. Further, the driving plate 60 has a sensing piece 61*a* of an elongated shape which extends from a part of the driving plate 60. Accordingly, when the driving plate 60 is rotated, the sensing piece 61*a* is moved between the first sensor 71 and the second sensor 72, thereby sensing the rotational position of the driving plate 60.

The motor body 11 and the gears 12, 13 and 14 are positioned between the pair of support portions 52 of the driving module 50, and the worm gear 14 connected on the same shaft to the dependent gear 13 is located on the top of the driving plate 60 as illustrated in FIGS. 5A and 5B when the drive module 50 is seen from the front of a door D and is connected to mesh with an outer toothed gear 61 of the driving plate 60. Further, an electric wire W for power supply or communication is connected to the PCB 70, and the electric wire W is arranged along a periphery of the driving plate 60 and drawn out to the outside.

Referring to FIGS. 5A to 6B and FIGS. 9A to 14, a clutch engagement structure of the shafts of the invention will be described below.

As illustrated in FIGS. 6A and 6B, a first shaft 41 includes an insertion end portion 41*a* having an outer cylindrical surface at its end portion. A second shaft 42 includes a hollow engagement end portion 42*a* having an inner cylindrical surface at one end of the second shaft 42. In the present invention, the insertion end portion 41*a* formed at one end portion of the first shaft 41 and hollow engagement end portion 42*a* formed at one end of the second shaft 42 are adapted to serve as clutch. In the present invention it will be defined as "a clutch engagement" that the first shaft 41 and the second shaft 42 are engaged with each other at the insertion end portion of the first shaft 41 and at the hollow engagement end portion 42*a* of the second shaft 42, respectively and coupled to each other by an insertion of a pin member P1 and P2.

The first shaft 41 and the second shaft 42 are clutch-engaged to each other or clutch-disengaged by means of a clutch pin member. Specifically, an insertion end portion 41*a* with a channel 41*h* is formed at one end of the first shaft 41. A mounting groove 41*c* is formed in a longitudinal direction of the first shaft 41 on an inner surface of the channel 41*h* of the insertion end portion 41*a* and a coil spring S is inserted into the mounting groove 41*c*.

On the other hand, the second shaft 42 includes a hollow engagement end portion 42*a* at one end of the second shaft 42. The insertion end portion 41*a* of the first shaft 41 is inserted into and engaged with the hollow engagement end portion 42*a* of the second shaft 42. The hollow engagement end portion 42*a* includes a hollow inner cylindrical surface extending along a longitudinal axis of the hollow engagement end portion 42*a*; a through hole 42*h* extending perpendicularly to a longitudinal axis of the hollow engagement end portion 42*a*; and a connection groove 43 formed at the hollow inner cylindrical surface to be diagonally opposite to the through hole. That is, the through hole passes through a circumference of the hollow engagement end portion 42*a* and is directed towards the center of the hollow engagement end portion 42*a*, and a connection groove 43 is formed at an inner circumferential surface of the hollow engagement end portion 42*a* and is placed to be diagonally opposite to the through hole 42*h* (see FIGS. 6*a* and 6B). Here, a first pin member P1 is inserted into the through hole 42*h* and a second pin member P2 is located under the first pin member P1. The second pin member P2 includes a pair of protruding fixing jaws a1 in upper and lower portions thereof.

Next, the assembling process of a first shaft and a second shaft will be described in detail as follows:

As illustrated in FIGS. 6A, 6B and 9B, a coil spring S is inserted into a mounting groove 41*c* of the first shaft 41. With the coil spring S mounted into the mounting groove 41*c* of the first shaft 41, a second pin member P2 is inserted into a channel 41*h* of the first shaft 41 such that the coil spring S is located between protruding fixing jaws a1 of the second pin member P2.

As illustrated in FIG. 9A, in a state in which the coil spring S is inserted into the mounting groove 41*c* of the first shaft 41 and the second pin member P2 with the protruding fixing jaw a1 is installed within the channel 41*h* of the first shaft 41, the first shaft 41 is inserted into a hollow engagement end portion 42*a* of the second shaft 42.

Finally, a first pin member P1 is inserted into a through hole 42*h* of the second shaft 42.

As illustrated in FIGS. 11A to 11C, the coil spring S is inserted and installed in the mounting groove 41*c* of the first shaft 41 in a state in which the edge periphery on both sides of the coil spring S is supported by the mounting groove 41*c*. The fixing jaws a1 of the second pin member P2 are positioned with respect to the coil spring S such that a longitudinal axis of the second pin member P2 positioned in the hollow engagement end portion 42*a* of the second shaft 42 (see FIGS. 8A and 8B), is parallel with axes normal to a plane including a circle defined at top and bottom ends of the coil spring S as shown in FIG. 11B. The fixing jaws a1 of the second pin member P2 are positioned with respect to the coil spring S such that planes of the fixing jaws thereof which face both ends of the coil spring S are parallel with a plane including a circle defined at top and bottom ends of the coil spring S as shown in FIG. 11B.

The second pin member P2 which is in a state of being installed in the hollow engagement end portion 42*a* of the second shaft 42 is elastically supported by the coil spring S because the coil spring S is located between the fixing jaws a1 of the second pin member P2, and the second pin member P2 is moved within a channel 41*h* of the first shaft 41. In addition, in this elastically-supported state, the second pin member P2 supports the bottom end of the first pin member P1, so that the first pin member P1 is also elastically supported. This is one of the important features of the invention.

Here, as illustrated in FIG. 11C, a width SL of the coil spring S is larger than a width L1 of the second pin member P2 and smaller than a distance L2 between the mounting groove 41*c* of the first shaft 41. That is, the coil spring S is located in a state of being inserted into the mounting groove 41*c* of the first shaft 41 between the fixing jaws a1 of the second pin member P2. As a result, although the movement of the second pin member P2 within the channel 41*h* of the first shaft 41 is restrictive because the fixing jaws a1 of the second pin member P2 are blocked by the coil spring S when the second pin member P2 is moved upwardly and downwardly, the second pin member P2 is upwardly and downwardly movable in the channel 41*h* of the first shaft 41 within a limited range by pressing and is returnable to the original position (at an intermediate position in the channel; 41*h*) by the elastic force of the coil spring S, as illustrated in FIGS. 11A to 11C.

On the other hand, in this way, the first pin member P1, which is elastically supported by the second pin member P2, is exposed to the outside of the hollow engagement end portion 42*a*.

As illustrated in FIG. 5A and FIG. 5B, since the first pin member P1 is selectively pressed by an inner curved surface 64 (See FIG. 15) of the driving plate 60, a clutch engagement and disengagement between the first shaft 41 and the second shaft 42 may be implemented wherein the inner curved surface 64 will be discussed in greater detail below.

First, as shown in FIGS. 5A, 5B, 7A, 7B, and 16 to 23, the driving plate 60 has an inner curved surface 64 at the inside thereof. The inner curved surface 64 is formed of a surface 64*a* having a small radius of curvature (in this specification, the surface having the small radius of curvature is defined as an inner cam surface) and a circular inner circumferential surface 64*b* having a radius of curvature larger than that of the inner cam surface.

Now, the clutch engagement between the first shaft 41 and the second shaft 42 will be specifically described.

First, when a door lock is authenticated, the motor body 11 is driven and a driving force of the motor body 11 causes the worm gear 14 to rotate the driving plate 60.

In the initial position as illustrated in FIGS. 5A, 7A, 8A and 10A, the first pin member P1 (including the second pin member P2) is positioned in the inner cam surface 64*a* of the inner curved surface 64 (in the clearance space) so that the first shaft 41 is only in an inserted state into the second shaft 42 and thus the first shaft 41 and the second shaft 42 may be rotated independently of each other in a state of clutch-disengagement between the first and second shafts 41 and 42.

However, when the driving plate 60 is rotated as illustrated in FIG. 5B, the first pin member P1 is pressed by the circular inner circumferential surface 64*b* having a radius of curvature larger than that of the inner cam surface in the driving plate 60, so that the first pin member P1 and the second pin member P2 are simultaneously lowered. Therefore, the first shaft 41 and the second shaft 42 are brought into the clutch engagement state (see FIGS. 10A to 10C).

Referring to FIGS. 7A, 7C, and 8A, the clutch-disengagement state of the present invention will be again described in greater detail below. In a normal state prior to the authentication, the first pin member P1 is positioned in a region having a smaller radius of curvature of the inner curved surface 64 (in the inner cam surface; 64*a*) inside the driving plate 60. That is, in this state, the first pin member P1 is supported by the second pin member P2 in a state in which the first pin member P1 is not inserted into the channel 41*h* of the first shaft 41. Also, the second pin member P2 is located in a state in which it is not inserted into the connection groove 43 of the second shaft 42. Therefore, in this state the first shaft 41 and the second shaft 42 may be rotated independently of each other without interlocking with each other.

Next, referring to FIGS. 7A and 7B, the clutch-engagement state will be again described in greater detail below. After the authentication is completed, the driving plate 60 is rotated by the motor unit 10 and in this state, the first pin member P1 is pressed by a region having a larger radius of curvature of the inner curved surface 64 (by the circular inner circumferential surface 64*b*) inside the driving plate 60. Therefore, in this state a lower portion of the first pin member P1 is positioned in the channel 41*h* of the first shaft 41 and an upper portion of the first pin member P1 is positioned within the through hole 42*h* of the second shaft 42. In addition, the second pin member P2 is lowered as the first pin member P1 is lowered wherein the second pin member P2 is lowered while overcoming the elastic force of the coil spring S. Then at last a bottom portion of the second pin member P2 is located in the connection groove 43 of the second shaft 42, and a bottom portion of the first pin member P1 is located in the channel 41*h* of the first shaft 41 (see FIGS. 7B and 10C).

In such a clutch-engagement state, the first pin member P1 and the second pin member P2 are placed in the through-hole 42*h* of the second shaft 42 and the channel 41*h* of the first shaft 41; and the channel 41*h* of the first shaft 41 and the connection groove 43 of the second shaft 42, respectively. Therefore, when the first shaft 41 or the second shaft 42 is rotated in this state, the shafts 41 and 42 are rotated together to establish a clutch-engagement state.

According to the present invention having such a configuration, the driving plate 60 is rotated through the driving module 50 by the driving force of the motor unit 10. Here, the rotating driving plate 60 presses the first pin member P1 by means of the circular inner circumferential surface 64*b* of the inner curved surface inside the driving plate 60. When the first pin member P1 is lowered by pressing, the second pin member P2 located on the bottom end of the first pin member P1 is also lowered while overcoming the elastic force of the coil spring S. Accordingly, when the first pin member P1 and the second pin member P2 are simultaneously lowered due to the rotation of the driving plate 60, the first pin member P1 and the second pin member P2 are placed in the channel 41*h* of the first shaft 41 and the through-hole 42*h* of the second shaft 42; and the channel 41*h* of the first shaft 41 and the connection groove 43 of the second shaft 42, respectively, thereby establishing the clutch-engagement state between the shafts 41 and 42 (see FIG. 10C). On the other hand, in the first original state the first shaft 41 and the second shaft 42 may be rotated independently of each other without interlocking with each other.

As described above, according to the present invention, since each of two pin members P1 and P2 is inserted to extend over both of the shafts, a firm fastening force may be ensured during engagement of clutches. The driving plate 60 of the driving module 50 having the inner cam surface 64*a* formed at the inside thereof is rotated thereby to easily press the first pin member P1, so that the clutch engagement between the shafts may be established. Accordingly, the drive device for clutch engagement assembly of the door lock device according to the invention may be miniaturized and demonstrate a smooth operation performance.

In addition, it is possible to provide for a drive device of proper dimensions to be applied to various clutch engagement structures tailored to the recent miniaturization of the door lock device, thereby improving versatility.

Embodiment 2

Referring to FIGS. 15 and 16, a mounting module 50 includes a motor unit 10, a driving plate 60, a first shaft 41, a second shaft 42, and a pin clutch member (reference number not assigned).

A first shaft 41 and a second shaft 42 are installed to be arranged on a center axis of the mounting module 50. The motor unit 10 is mounted on an upper portion of the mounting module 50 and the motor unit 10 provides a driving force for rotating the driving plate 60 installed in the mounting module 50.

The driving plate 60 has an inner curved surface 64 at the inside thereof. The inner curved surface 64 has an inner cam surface 64*a* at one portion thereof and a circular inner circumferential surface 64*b* at the other portion thereof wherein the inner cam surface 64*a* has a radius of curvature smaller than that of the circular inner circumferential surface 64*b*. At a portion of the outer circumferential surface of the driving plate 60 there is formed an outer toothed gear 61.

Since the worm gear 14 is connected to mesh with an outer toothed gear 61 of a driving plate 60, the rotation of the worm gear 14 causes the driving plate 60 to be rotated clockwise or counter-clockwise.

The outer toothed gear 61 of the driving plate 60 is connected to the motor unit 10 by gears connection and thus is rotated by the driving force of the motor unit 10.

Here, the driving plate 60 is installed to be inserted on an outer circumferential surface of a hollow engagement end portion 42*a* of the second shaft 42. A part of the hollow engagement end portion 42*a* of the first shaft 41 is inserted into the hollow engagement end portion 42*a* of the second shaft 42, and the first shaft 41 and the second shaft 42 may be connected by a clutch pin member. The clutch pin member is also moved upwards and downwards so as to fix both the first and second shafts 41, 42 by the rotation of the driving plate 60 (this will be described in greater detail below).

In addition, a PCB (P) is mounted inside the mounting module 50, and a cover plate 51 is mounted to cover the above-described internal components when these internal components are installed. Here, the first shaft 41 protrudes through a through hole 51*h* of the cover plate 51.

The first shaft 41, for example, may be coupled to a handle shaft, and the second shaft 42 may be coupled to a rotating body of a latch assembly 20, for example. Thus, when the handle shaft is rotated in the state in which the first shaft 41 and the second shaft 42 are connected to each other (the clutch-engagement state) by operating the driving plate 60, the driving force of these shafts is transmitted to the rotating body of the latch assembly 20, thereby forming an unlocked state of the latch assembly.

The motor unit 10 is constructed in such a manner that a first case 10*a* and a second case 10*b* are coupled to each other and inside these cases a second gear 13 is connected to mesh with a driving gear M1 of a motor M, and a first gear 11 is connected to mesh with the second gear 13. These gears may also have other shapes depending on reduction ratios therebetween. The first gear 11 has a rotating shaft 11*a* extending to one side thereof and a worm gear 12 is mounted on a rotating shaft 11*a* with a coil spring 11*s* inserted therein. Here, a spline is formed on the rotating shaft 11*a*, and the worm gear 12 is fitted along the spline to cooperate with an outer toothed gear 61.

As a result, as the motor M is driven the first gear 11 may be rotated and the driving plate 60 may be rotated via the worm gear 12.

Meanwhile, referring to FIG. 6A, with respect to a clutch pin member of the present invention, a through hole 42*h* is formed to pass through one portion of a circumference of a hollow cylinder wall at an upper portion of a hollow engagement end portion 42*a* of the second shaft 42 and a connection groove 43 is formed to be diagonally opposite to the through hole 42*h* at an inner circumferential surface of the hollow engagement end portion 42*a*. Here, a first pin member P1 is inserted into the through hole 42*h* and a second pin member P2 is positioned on a bottom end of the first pin member P1. According to the circumstances, such a plurality of pins P1 and P2 may be formed as a single clutch pin member integrally formed.

Further, a mounting groove 41*c* of the coil spring S is formed in the first shaft 41. The first shaft 41 is positioned inside hollow engagement end portion 42*a* of the second shaft 42 while the first shaft 41 is connected to the second shaft 42 with the second pin member P2 being elastically supported by a coil spring S. Thus, the first pin P1 is installed to be protruded through the through hole 42*h* of the second shaft 42 and the second pin P2 is installed on a bottom end of the first pin P1 to be elastically supported by the coil spring S. That is, the first pin P1 is located while being supported by the second pin P2.

Referring to FIG. 15, a driving plate 60 is rotatably positioned inside a mounting module 50 around an external circumference of a hollow engagement end portion 42*a* of a second shaft 42. Since an outer toothed gear 61 formed on the outer circumferential surface of the driving plate 60 is connected to mesh with a worm gear 12 connected to a first gear 11 of a motor unit 10, the driving plate 60 is rotated around the hollow engagement end portion 42*a* of the second shaft 42 by a rotating force of a motor M. Here, the driving plate 60 has a sensing piece 61*a* protruding from the outer circumferential surface thereof and the position of the sensing piece 61*a* is detected by a first sensor S1 and a second sensor S2 mounted on a PCB 70. For example, as the driving plate 60 rotates, a sensing member 62 located at the first sensor S1 moves to the second sensor S2, so that a control unit may sense the operation position of the driving plate 60.

Referring to FIGS. 16 and 17, an inner curved surface 64 of a driving plate 60 installed inside a mounting module 50 is formed to have a size corresponding to the outer circumferential surface of a hollow engagement end portion 42*a* of a second shaft 42. Here, an inner cam surface 64*a* is formed on one portion of the inner curved surface 64 of the driving plate 60 to have a radius of curvature smaller than a radius of the outer circumference of the hollow engagement end portion 42*a*. That is, the inner cam surface 64*a* is formed at the one portion of the inner curved surface 64 to have a margin between the inner cam surface 64*a* and the outer circumference of the hollow engagement end portion 42*a* to the extent that a first pin P1 protruding from the outer peripheral surface of the second shaft 42 is not pressed by the inner cam surface 64*a* of the inner curved surface 64.

Accordingly, when a worm gear 12 rotates the driving plate 60 by the rotation of a motor M, the driving plate 60 is rotated from a position illustrated in FIG. 16 to a position illustrated in FIG. 17. At this time, the inner cam surface 64*a* of the driving plate 60 is moved clockwise, so that the first pin P1 in a pulled-out state is lowered by pressing a circular inner circumferential surface 64*b* of the inner curved surface 64 formed inside the driving plate 60. Accordingly, a second pin P2 is lowered by the first pin P1 thus to establish the clutch-engagement state of a first shaft 41 and the second shaft 42.

Referring to FIGS. 18 and 19, FIG. 18 shows the positional relationship between a first pin P1 and a second pin P2 in the clutch-disengagement state of a first shaft 41 and a second shaft 42. In the clutch-disengagement state of FIG. 18, the first pin P1 in the pull-out state (original position) is located only in a hollow engagement end portion 42*a* of the second shaft 42, and does not interfere in the first shaft 41, i.e., is not inserted into the first shaft 41. The second pin P2 is also positioned only inside the first shaft 41 and top and bottom ends of the second pin P2 do not interfere in the hollow engagement end portion 42*a* of the second shaft 42. In other words, even if the first shaft 41 is rotated by rotating a handle shaft in this state, the rotating force is not transmitted to the second shaft 42 (clutch disengagement state).

On the other hand, as illustrated in FIG. 19, when, as the driving plate 60 is rotated, the first pin member P1 is pressed by a circular inner circumferential surface 64*b* having a radius of curvature larger than that of an inner cam surface 64*a* in the driving plate 60 wherein the circular inner circumferential surface 64*b* has a radius of curvature which corresponds to a radius of the outer circumference of the hollow engagement end portion 42*a*, the first pin member P1 is lowered and the second pin member P2 positioned on a bottom end of the first pin member P1 is also lowered accordingly. Here, one end of the first pin P1 is located inside the second shaft 42 and the other end of the first pin P1 is located inside the first shaft 41. Further, The second pin P2, which is in a lowered state due to an elastic force of a coil spring S, is located in a connection groove 42*h* at one end of the second pin P2 which faces away from the first shaft 41, and the remaining portion of the second pin P2 is located inside the first shaft 41. Therefore, the clutch engagement between the first shaft 41 and the second shaft 42 are established at their ends. That is, in this state when the first shaft 41 is rotated by rotating a handle shaft, the second shaft 42 is rotated together therewith so that a latch assembly 20 may be driven by the rotating force (clutch-engagement state).

Conversely, when the driving plate 60 returns to its original state, the second pin P2 pushes up the first pin P1 by the resilient force, thereby establishing a clutch-disengagement state, as illustrated in FIGS. 16 and 18.

Referring to FIGS. 20 and 21, according to the present invention, even if a driving plate 60 is rotated in either of clockwise and counter-clockwise directions, a circular inner circumferential surface 64*b* having a radius of curvature larger than a radius of curvature of a inner cam surface 64*a* may press a first pin P1. Therefore, any structural change is not required due to the switching of the rotating direction, thereby providing a high convenience of use.

Referring to FIGS. 22 and 23, the invention may provide a structure to solve the problem that a damage of a motor M arises when the actuation of a driving plate 60 is stopped during the actuation of a door lock device due to the jamming of a handle shaft and the like and thereby a reaction force transmitted by the stop of the driving plate 60 is transferred to the motor.

Specifically, according to the present invention, there is provided a connection releasing member for shutting off a connection to a motor unit 10.

The connection releasing member provided in the present invention includes a first gear 11; a rotating shaft 11*a* extending by a predetermined length on one side of the first gear 11; a coil spring 11*s* inserted into the rotating shaft 11*a*; a worm gear 12 mounted at one end of the rotating shaft 11*a* to be elastically supported by a coil spring 11*s*; and an outer toothed gear 61 formed at a portion of the outer circumferential surface of the driving plate 60.

Accordingly, when the first gear 11 is driven by the actuation of the motor M, since the worm gear 12 is connected to the first gear 11 by the spline formed in the rotating shaft 11*a* of the first gear 11, the worm gear 12 is rotated with the first gear 11. At this state, when the driving plate 60 may not be rotated due to the jamming of the handle shaft and the like, the worm gear 12 continues to rotate but the worm gear 12 does not drive the jammed driving plate 60. In this situation, the worm gear 12 moves along the outer toothed gear 61 of the driving plate 60 in the leftward direction (moves by a kind of rack-and-pinion motion) while overcoming the elastic force of the coil spring 11*s* as illustrated in FIG. 23.

When the worm gear 12 is rotated in the state where the driving plate 60 is stopped, the worm gear 12 is moved in the left direction of the rotation shaft 11*a* of the first gear 11 (that is, moved along the teeth of the outer toothed gear) and when the worm gear 12 is moved to the leftmost side of the rotating shaft 11*a*, the worm gear 12 is disengaged from the outer toothed gear 61 of the driving plate 60. Therefore, it is possible to prevent the reaction force due to jamming from being transmitted to the motor unit 10. Also, here, a controller which may sense the jam and then may stop the driving of the motor M.

Therefore, the present invention may prevent a device failure resulting from an overload applied to the device when the motor M is continuously driven in a state where the driving plate 60 is stopped due to jamming during operation.

While the present invention has been particularly illustrated and described with reference to exemplary embodiments thereof, it is clearly understood that the same is by way of illustration and example only and is not to be construed as limited to the embodiments set forth herein. It will be understood that the invention may be varied in many ways within the scope not departing from the gist of the invention.

What is claimed is:

1. A door lock device having a clutch engagement assembly thereof for the door lock device comprising:

a mounting module formed in a disc shape with a peripherally-located cutaway portion, and mounted on an installation hole;

a motor unit having a complimentary shape to the cutaway portion, and coupled to the mounting module to provide a driving force;

a driving plate rotating in the mounting module by a driving force of the motor unit;

a first shaft having at an end thereof an insertion end portion in which a channel is formed;

a second shaft having a hollow engagement end portion into which the insertion end portion of the first shaft is inserted;

a driving member which provides a driving force; and a pin member that is installed in a state of being elastically supported in the hollow engagement end portion of the second shaft and is movable by the driving member so as to be inserted to extend over at least both of a part of the first shaft and a part of the second shaft, thereby enabling a clutch engagement or disengagement between the first shaft and the second shaft, wherein said clutch engagement assembly has a shape corresponding to the installation hole as a whole in a state where the motor unit is coupled to the mounting module.

2. The door lock device according to claim 1, wherein the pin member includes a first pin member a part of which is exposed outward from the outer surface of the hollow engagement end portion of the second shaft, and a second pin member which is elastically supported inside the insertion end portion of the first shaft and supports the first pin member at a bottom end thereof.

3. The door lock device according to claim 2, wherein the engagement end portion of the second shaft includes a hollow inner cylindrical surface extending along a longitudinal axis of the engagement portion; a through hole which extends perpendicularly to the longitudinal axis of the engagement end portion; and a connection groove which is formed at the hollow inner cylindrical surface to be diagonally opposite to the through hole, wherein the first pin member is installed in a state of protruding at a predetermined length from the through hole, the second pin member includes a pair of protruding fixing jaws in upper and lower portions thereof and a coil spring is located between the protruding fixing jaws of the second pin member.

4. The door lock device according to claim 3, wherein at an inner circumferential surface of the engagement end portion there is formed the connection groove into which one end portion of the second pin member is inserted and the connection groove is placed to be diagonally opposite to the through hole.

5. The door lock device according to claim 4, wherein when the first pin member is lowered by the driving member, the first pin member is positioned to extend through both the through hole of the second shaft and the channel of the first channel; wherein the second pin member is lowered while overcoming an elastic force of the coil spring as the first pin member is lowered, so that the second pin member is placed to extend through the channel of the first shaft and the connection groove of the second shaft; and wherein the coil spring is actuated only within a mounting groove formed in the first shaft.

6. The door lock device according to claim 3, wherein a mounting groove is formed in the longitudinal direction of the first shaft in inner surfaces of both sides of the channel of the first shaft; wherein the second pin member is positioned to be moveable upwards and downwards in the channel of the first shaft; and wherein the coil spring is actuated only in the mounting groove of the first shaft while being supported by the protruding fixing jaws of the second pin member.

7. The door lock device according to claim 6, wherein a width of the coil spring is greater than a width of the second pin member and smaller than a distance between the mounting groove of the first shaft.

8. The door lock device according to claim 1, wherein the driving member is formed in a hollow circular plate having an inner curved surface formed therein; and the inner curved curve includes an inner cam surface and a circular inner circumferential surface, and when the driving member rotates, the inner curved surface causes the first and second pin members to be moved upwardly or downwardly within the channel of the first shaft and the through hole of the second shaft and into a connection groove of the second shaft.

9. The door lock device according to claim 1, wherein an outer toothed gear connected to mesh with the motor unit is formed on a part of an outer circumferential surface of the driving plate, and a cam surface for moving the pin member in the vertical direction is formed in a part of an inner circumferential surface of the driving plate.

10. The door lock device according to claim 9, wherein the first shaft and the second shaft are connected at each of their ends, the pin member is inserted upward and downwards into an end of the second shaft, the pin member is elastically supported at the end of the second shaft by a coil spring, and the pin member is lowered from its original position to move to a position in which it passes through both ends of the first shaft and the second shaft.

* * * * *